US011268679B2

(12) United States Patent
Zeng et al.

(10) Patent No.: US 11,268,679 B2
(45) **Date of Patent: *Mar. 8, 2022**

(54) DOWNLIGHT APPARATUS WITH HEAT DISSIPATION

(71) Applicant: XIAMEN ECO LIGHTING CO. LTD., Xiamen (CN)

(72) Inventors: Maojin Zeng, Xiamen (CN); Xiaojuan Huang, Xiamen (CN); Hao Luo, Xiamen (CN); Huitang Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,463

(22) Filed: Feb. 4, 2020

(65) Prior Publication Data

US 2020/0173634 A1 Jun. 4, 2020

Related U.S. Application Data

(63) Continuation of application No. 16/109,524, filed on Aug. 22, 2018, now Pat. No. 10,591,142.

(30) Foreign Application Priority Data

Sep. 5, 2017 (CN) ..... 201721133207.1

(51) Int. Cl.

| | |
|---|---|
| ***F21V 19/00*** | (2006.01) |
| ***F21V 29/508*** | (2015.01) |
| ***F21V 29/70*** | (2015.01) |
| ***F21V 17/08*** | (2006.01) |
| ***F21V 23/00*** | (2015.01) |
| ***F21V 17/12*** | (2006.01) |
| *F21Y 115/10* | (2016.01) |

(52) U.S. Cl.

CPC ..... *F21V 19/004* (2013.01); *F21V 17/08* (2013.01); *F21V 19/0035* (2013.01); *F21V 23/009* (2013.01); *F21V 29/508* (2015.01); *F21V 29/70* (2015.01); *F21V 17/12* (2013.01); *F21Y 2115/10* (2016.08)

(58) Field of Classification Search

CPC ..... F21V 29/70; F21V 29/508; F21V 23/009; F21V 19/004; F21V 19/0035; F21V 17/08

See application file for complete search history.

(56) References Cited

U.S. PATENT DOCUMENTS

| | | | | |
|---|---|---|---|---|
| 10,132,477 | B1 * | 11/2018 | Winters | F21V 21/30 |
| 10,400,965 | B1 * | 9/2019 | Li | F21V 15/01 |
| 10,591,142 | B2 * | 3/2020 | Zeng | F21V 19/004 |
| 2016/0281939 | A1 * | 9/2016 | Luk | F21V 21/047 |
| 2018/0313524 | A1 * | 11/2018 | Vidal | F21V 23/009 |

* cited by examiner

*Primary Examiner* — Rajarshi Chakraborty
*Assistant Examiner* — Nathaniel J Lee
(74) *Attorney, Agent, or Firm* — Chun-Ming Shih; Lanway IPR Services

(57) ABSTRACT

A downlight apparatus includes a light module, connecting arms and a driver box. The connecting arms are fixed to a back cover of the light module. The connecting arm has a guiding top and a lateral stopper for entering a receiver slit of the driver box. The lateral stopper and the guiding top may be made of one metal piece, and the lateral stopper is protruding at a lateral side of the connecting arm so that to fix the connecting arm to the driver box.

18 Claims, 8 Drawing Sheets

DOWNLIGHT APPARATUS WITH HEAT DISSIPATION

RELATED APPLICATION

The present application is a continued application of U.S. patent application Ser. No. 16/109,524.

FIELD OF INVENTION

The present invention is related to a LED light apparatus and more particularly related to a LED light apparatus with less components.

BACKGROUND

There are various lighting devices designed for satisfying different needs. For example, there are light bulbs to be installed on sockets. Such light bulbs are usually easy to be installed by users. For downlight devices used in normal home, it would be important to consider convenience for installation, safety and replacement.

In addition to consider the user aspect, it is found that manufacturers and sales channels are also important places to provide innovative designs. After all, the total cost of a light device, which affects whether the product may be widely broadcasted, is not only manufacturing and component cost. For example, storage cost in sales channel is also an important factor.

Some components, particularly light guide plates, are not easy to be manufactured, compared with other components. In addition, light guide plates usually need more protection and cause manufacturing process more complicated for building a high-end environment.

Therefore, it would be beneficial to provide designs that are easily to be installed, assembled, and thus even help decrease total cost. On the other hand, it would be even better if further advantages may be introduced in the same products.

SUMMARY OF INVENTION

According to an embodiment, an LED light apparatus includes a light module, multiple connecting arms and a driver box.

The light module includes a light source and a main housing. The light source is mounted with LED modules and placed in the main housing. The main housing has a light opening for light of the LED modules to escape out of the LED light apparatus. The main housing has a back cover. The main housing may have a circular, rectangular or other geometric shape. For example, the light module may be a panel light with a light guiding plate and a diffusion plate so that LED modules located at lateral inner side of the main housing is guided by the light guiding plate and escaped outside the LED light apparatus from the diffusion plate. For another example, the LED modules may be located at an inner top side and the main housing may include lens, reflector or other optical components forming a downlight, a spot light, or other light modules.

In some embodiments, the back cover may refer to a back side opposite to the light opening. Specifically, the back cover may refer to an exterior surface of the main housing.

Multiple connecting arms are fixed on the back cover of the light module. The connecting arm may have a guiding top, a lateral stopper and a main body. The guiding top is located at a top side of the main body. The lateral stopper is located at a lateral side of the main body and protruding from the lateral side of the main body.

The driver box has multiple receivers for coupling to the corresponding connecting arms. The receiver has a receiver slit. After the guiding top and the lateral stopper of the connecting arm enter the receiver slit in sequence, a bottom side of the lateral stopper engages the receiver and thus fixes the driver box to the light module.

In some embodiments, the lateral stopper is elastic to deform when passing the receiver slit and recovered after passing the receiver slit. For example, the lateral stopper may be an elastic clip structure that has a protruding part. The protruding part may be deformed during entering the receiver slit and recovered so as to engage the receiver to be locked at a predetermined position. With such design, the connecting arm that is originally fixed to the light module is used for fixing the light module to the driver box.

In some embodiments, the lateral stopper is a triangle protruding structure with a bottom part engaging a peripheral part of the receiver slit to keep the connecting arm staying at a predetermined relative position with respect to the driver box. Specifically, two sides of the triangle protruding structure are protruding over a surface of the main body of the connecting arm.

In some embodiments, the two sides of the lateral stopper have a top side and a bottom side. The top side has a smaller angle with respect to the surface of the main body than the bottom side. The bottom side engages a peripheral part of the receiver slit so as to fasten the connecting arm and the light module more closely to the driver box by using elastic force of the bottom side of the lateral stopper.

On the other hand, the smaller angle of the top side makes it easier to install the connecting arm into the receiver slit.

In some embodiments, there are two connecting arms with two lateral stoppers. Each lateral stopper is a part of a single piece metal unit of the connecting arm. Specifically, the guiding top, the main body and the lateral stopper are parts of a single piece metal unit. Furthermore, the two connecting arms are connected with a bottom part, and the bottom part, the two connecting arms are all parts of a single piece metal unit.

For example, an elongated metal bar may be folded as a U shape structure for forming the two connecting arms and the bottom part. Furthermore, the lateral stopper is formed by applying metal stamping on a lateral surface of the connecting arm.

The bottom part may be fixed to the back cover of the light module via screws or other fasteners.

Alternatively, the two connecting arms may be two separate L shape arms respectively having a bottom part fixed to the back cover of the light module.

In some embodiments, there may be more than three connecting arms. With three or four connecting arms, the driver box may be surrounded by the connecting arms and thus forms a more robust connection to the light module.

In some embodiments, the receiver is a clip with a containing space for storing the lateral stopper after the lateral stopper passes the receiver slit for fixing the connecting arm to the driver box. Other variations of the connecting arms and corresponding receivers may be used, too.

In some embodiments, the driver box is a metal box containing driver circuit components for converting an external power source to a driving current for the LED modules of the light module.

In some embodiments, the driver box is a cylinder shape, and the connecting arms have corresponding curve walls corresponding to the metal box. Specifically, the curve inner surface may help the connecting better fit the exterior surface of the driver box so as to form a robust connection between the driver box and the light module.

In some embodiments, the connecting arms transmit heat of the light module to the metal box for heat dissipation. With the tight engagement between the receiver and the lateral stopper, the heat conduction is enhanced.

In some embodiments, two of the connecting arms are connected with a shared bottom part. The shared bottom part has a protruding structure to keep a closer engagement with a surface of the driver box for better heat dissipation.

As mentioned above, two connecting arms may be made with one-piece metal unit as a U shape structure. The bottom par is shared by the two connecting arms. Certain protruding structures may help the bottom part more closely fit to the back cover of the light module so as to transmit heat more effectively.

In some embodiments, the guiding top may have a curve shape to prevent hurting users and makes it easier to install the connecting arm into the receiver slit.

In some embodiments, there are two receiver slits disposed at two opposite sides of the driver box. This design forms a robust connecting structure.

In some embodiments, the receiver slits are disposed on lateral sides of the driver box, the connecting arms entering tracks defined by the receiver slits. Specifically, the receiver slits are two tracks for inserting the connecting arms.

In some embodiments, the lateral stopper has multiple segments corresponding to different types of the driver box. For example, there may be several types of driver box with different sizes. The lateral stopper may have several segments corresponding to different parameters so as to be compatible for multiple types of driver box.

In some embodiments, there is a flat area of the back cover for engaging the driver box. The flat area helps a closer fitting between the driver box and the light module.

In some embodiments, a driver circuit is disposed away from a bottom part of the driver box, the bottom part of the driver box engages the back cover of the light module. Specifically, the bottom part of the drive box is close to the light module and may receive more heat. By disposing the driver circuit away from the bottom part of the driver box may keep the driver circuit a better operating environment.

In some other embodiments, there is a plastic driver box containing a driver circuit. The plastic driver box is disposed at a bottom part of the driver box. The bottom part of the driver box is the part that engages the back cover of the light module.

There may be a gap between the bottom part of the driver box and a bottom side of the plastic driver box for preventing affecting the operation of the driver circuit by heat of the light module.

In addition, there may be a containing space for containing connection parts of wires of the plastic driver circuit and external wires connecting to an external power source. The wiring space may occupy 30%~50% size of the driver box for providing a safer configuration.

DETAILED DESCRIPTION

According to an embodiment, an LED light apparatus includes a light module, multiple connecting arms and a driver box.

The light module includes a light source and a main housing. The light source is mounted with LED modules and placed in the main housing. The main housing has a light opening for light of the LED modules to escape out of the LED light apparatus. The main housing has a back cover. The main housing may have a circular, rectangular or other geometric shape. For example, the light module may be a panel light with a light guiding plate and a diffusion plate so that LED modules located at lateral inner side of the main housing is guided by the light guiding plate and escaped outside the LED light apparatus from the diffusion plate. For another example, the LED modules may be located at an inner top side and the main housing may include lens, reflector or other optical components forming a downlight, a spot light, or other light modules.

In some embodiments, the back cover may refer to a back side opposite to the light opening. Specifically, the back cover may refer to an exterior surface of the main housing.

Multiple connecting arms are fixed on the back cover of the light module. The connecting arm may have a guiding top, a lateral stopper and a main body. The guiding top is located at a top side of the main body. The lateral stopper is located at a lateral side of the main body and protruding from the lateral side of the main body.

The driver box has multiple receivers for coupling to the corresponding connecting arms. The receiver has a receiver slit. After the guiding top and the lateral stopper of the connecting arm enter the receiver slit in sequence, a bottom side of the lateral stopper engages the receiver and thus fixes the driver box to the light module.

In addition to attaching the inventive concept to connect a driver box to a light module, the structure may be used for connecting a light module to a fixing plate. The fixing plate may be some device to be fixed on a wall or a ceiling. Alternatively, the fixing plate is the bottom cover of a driver box.

Figure 1:
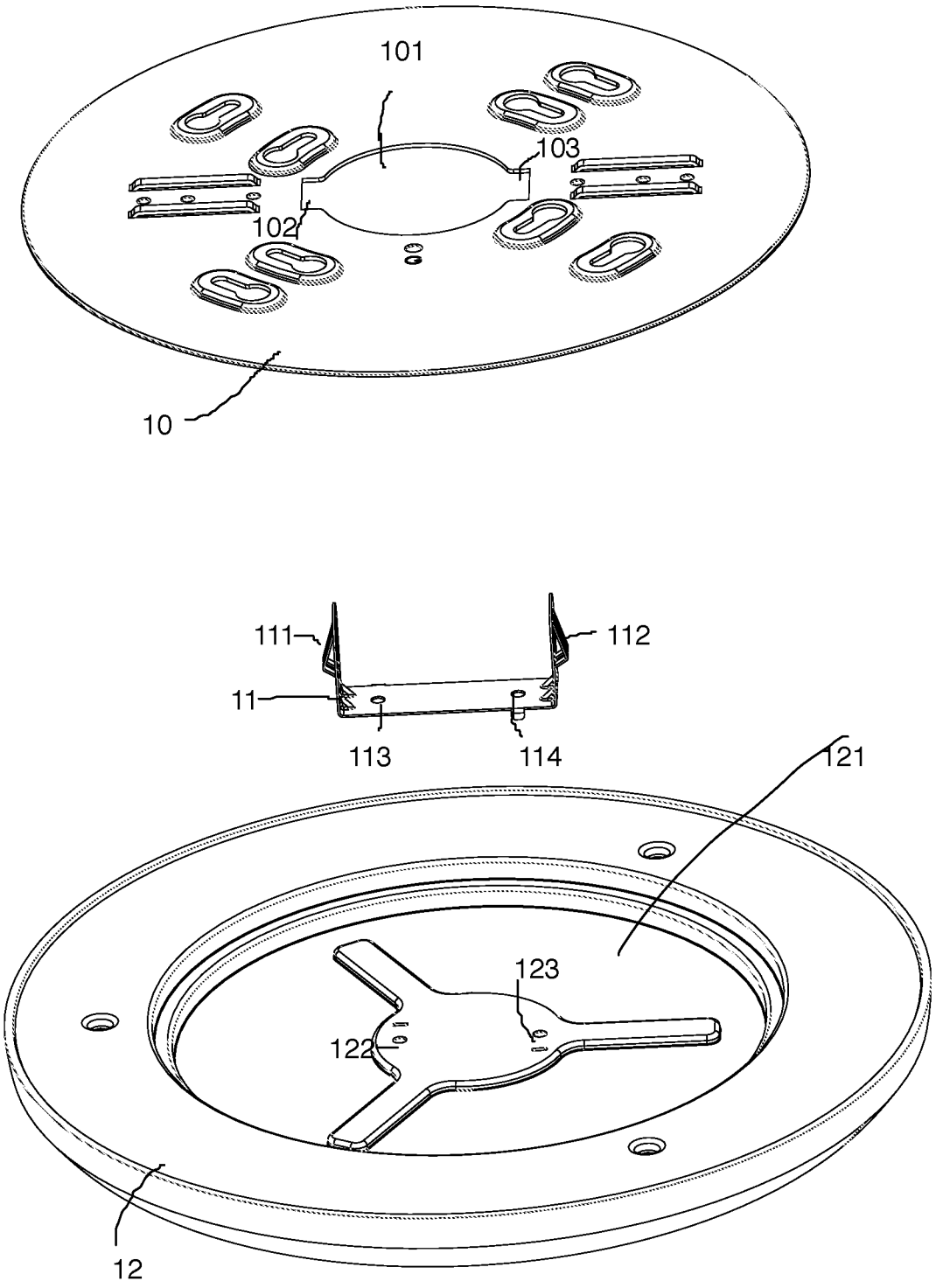
FIG. 1 illustrates an embodiment of a LED light apparatus with two connecting arms.
Figure 4A:
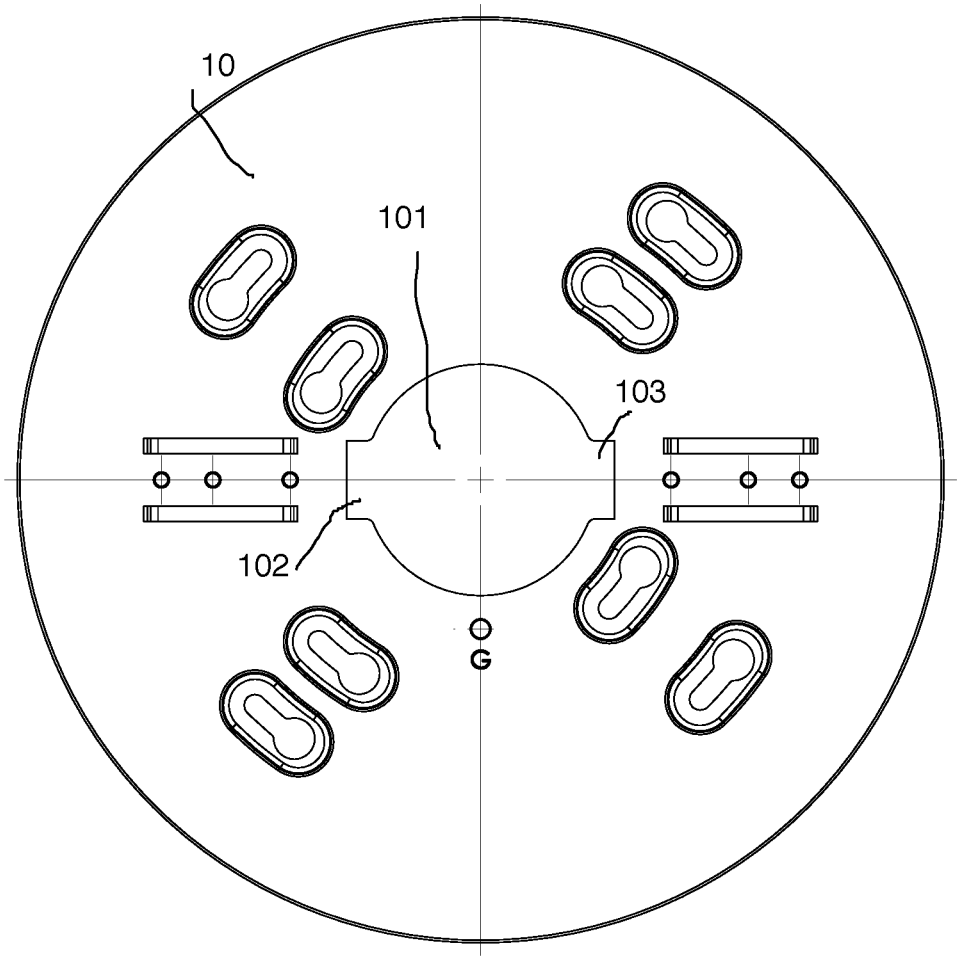
FIG. 4A and FIG. 4B illustrate a fixing plate example in an embodiment.
Figure 4B:
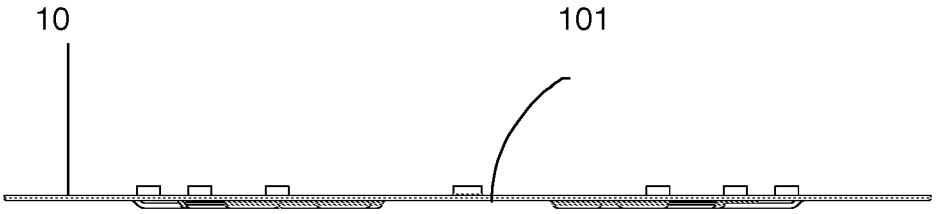

Please refer to FIG. 1, FIG. 4A and FIG. 4B. FIG. 1 illustrates an embodiment of fixing a light module 12 to a fixing plate 10. FIG. 4A illustrates a top view and a FIG. 4B illustrates a side view of the fixing plate.

In FIG. 1, the fixing plate has a hole 101 with two receiver slits 102 and 103 on two sides of the hole 101. There is a U shape structure connection device 11. The U shape connection device 11 may be made of a metal sheet by folding and metal stamping process.

The U shape structure connection device has two connecting arms 111, 112. Two screw holes 113, 114, in this example, are used for fixing the U shape structure connection device 11 to two corresponding fixing structures 122, 123 on a back cover 121 of a light module 12.

Figure 2:
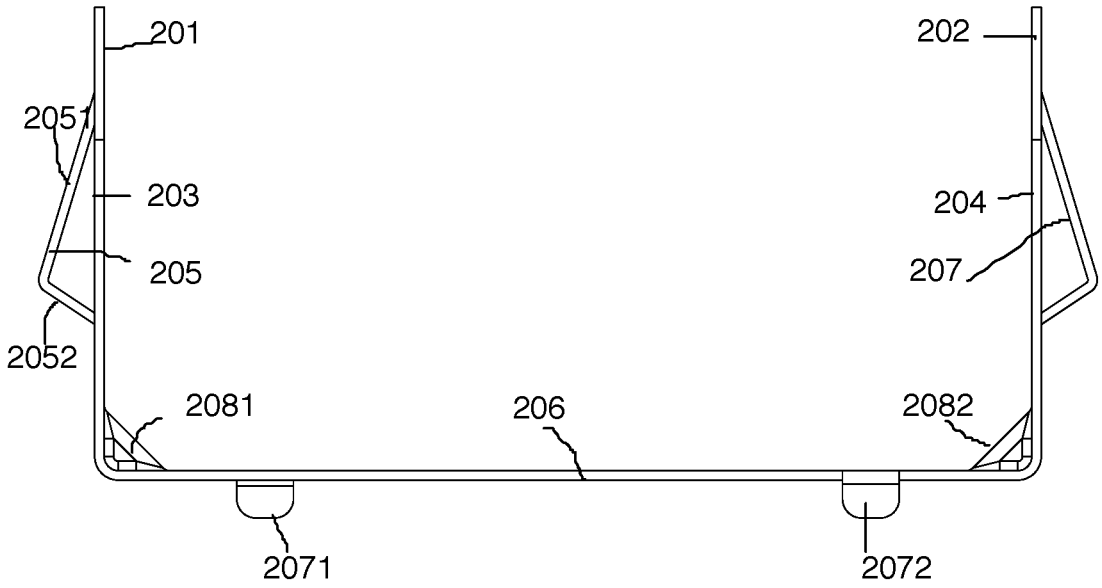
FIG. 2 illustrates a side view of a connecting arm example.
Figure 3:
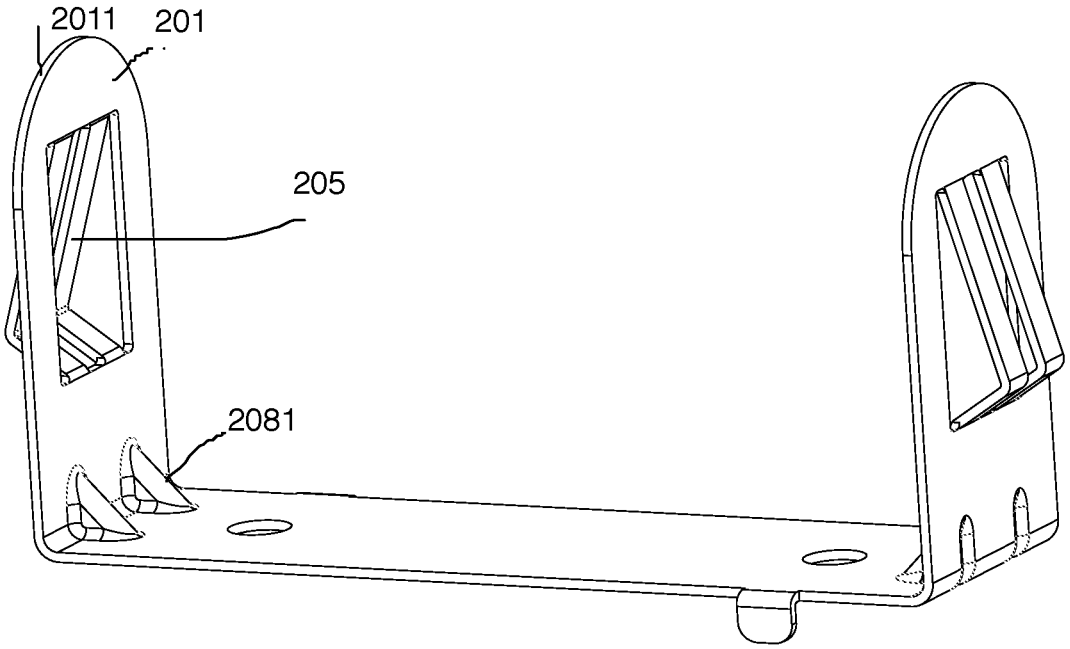
FIG. 3 illustrates a perspective view of the embodiment of FIG. 2

Please refer to FIG. 2 and FIG. 3. FIG. 2 and FIG. 3 illustrate a U shape connection device like the example in FIG. 1.

In FIG. 2 and FIG. 3, the U shape connection device has a bottom part 206 shared by two connecting arms. The connection arms have main bodies 203, 204. On top of the main bodies 203, 204, there are guiding tops 201, 202. On lateral sides of the connecting arms, there are lateral stoppers 205, 207. The lateral stopper 205, in this example, have triangle shapes and have a top side 2051 and a bottom side 2052. The top side 2051 has a smaller angle with respect to the main body 203 than the bottom side 2052.

There are two structural protruding structures 2081, 2082 to enhance rigidness of the U shape connection device. There are two fixing structures 2071, 2072 to be fixed to a back cover of a light module.

In some embodiments, the lateral stopper is elastic to deform when passing the receiver slit and recovered after passing the receiver slit. For example, the lateral stopper may be an elastic clip structure that has a protruding part. The protruding part may be deformed during entering the receiver slit and recovered so as to engage the receiver to be locked at a predetermined position. With such design, the connecting arm that is originally fixed to the light module is used for fixing the light module to the driver box.

In some embodiments, the lateral stopper is a triangle protruding structure with a bottom part engaging a peripheral part of the receiver slit to keep the connecting arm staying at a predetermined relative position with respect to the driver box. Specifically, two sides of the triangle protruding structure are protruding over a surface of the main body of the connecting arm.

In some embodiments, the two sides of the lateral stopper have a top side and a bottom side. The top side has a smaller angle with respect to the surface of the main body than the bottom side. The bottom side engages a peripheral part of the receiver slit so as to fasten the connecting arm and the light module more closely to the driver box by using elastic force of the bottom side of the lateral stopper.

On the other hand, the smaller angle of the top side makes it easier to install the connecting arm into the receiver slit.

In some embodiments, there are two connecting arms with two lateral stoppers. Each lateral stopper is a part of a single piece metal unit of the connecting arm. Specifically, the guiding top, the main body and the lateral stopper are parts of a single piece metal unit. Furthermore, the two connecting arms are connected with a bottom part, and the bottom part, the two connecting arms are all parts of a single piece metal unit.

For example, an elongated metal bar may be folded as a U shape structure for forming the two connecting arms and the bottom part. Furthermore, the lateral stopper is formed by applying metal stamping on a lateral surface of the connecting arm.

The bottom part may be fixed to the back cover of the light module via screws or other fasteners.

Alternatively, the two connecting arms may be two separate L shape arms respectively having a bottom part fixed to the back cover of the light module.

In some embodiments, there may be more than three connecting arms. With three or four connecting arms, the driver box may be surrounded by the connecting arms and thus forms a more robust connection to the light module.

In some embodiments, the receiver is a clip with a containing space for storing the lateral stopper after the lateral stopper passes the receiver slit for fixing the connecting arm to the driver box. Other variations of the connecting arms and corresponding receivers may be used, too.

In some embodiments, the driver box is a metal box containing driver circuit components for converting an external power source to a driving current for the LED modules of the light module.

In some embodiments, the driver box is a cylinder shape, and the connecting arms have corresponding curve walls corresponding to the metal box. Specifically, the curve inner surface may help the connecting better fit the exterior surface of the driver box so as to form a robust connection between the driver box and the light module.

In some embodiments, the connecting arms transmit heat of the light module to the metal box for heat dissipation. With the tight engagement between the receiver and the lateral stopper, the heat conduction is enhanced.

In some embodiments, two of the connecting arms are connected with a shared bottom part. The shared bottom part has a protruding structure to keep a closer engagement with a surface of the driver box for better heat dissipation.

As mentioned above, two connecting arms may be made with one-piece metal unit as a U shape structure. The bottom par is shared by the two connecting arms. Certain protruding structures may help the bottom part more closely fit to the back cover of the light module so as to transmit heat more effectively.

In some embodiments, the guiding top may have a curve shape to prevent hurting users and makes it easier to install the connecting arm into the receiver slit.

In some embodiments, there are two receiver slits disposed at two opposite sides of the driver box. This design forms a robust connecting structure.

In some embodiments, the receiver slits are disposed on lateral sides of the driver box, the connecting arms entering tracks defined by the receiver slits. Specifically, the receiver slits are two tracks for inserting the connecting arms.

In some embodiments, the lateral stopper has multiple segments corresponding to different types of the driver box. For example, there may be several types of driver box with different sizes. The lateral stopper may have several segments corresponding to different parameters so as to be compatible for multiple types of driver box.

In some embodiments, there is a flat area of the back cover for engaging the driver box. The flat area helps a closer fitting between the driver box and the light module.

Figure 5:
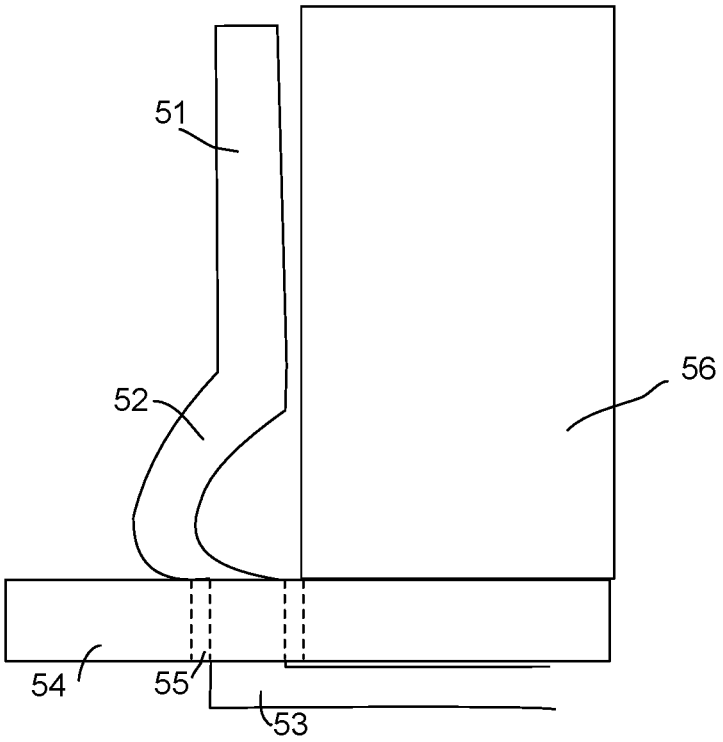
FIG. 5 illustrates a side view explaining relation among components.

Please refer to FIG. 5. FIG. 5 illustrates relation of components in an embodiment.

In FIG. 5, a connecting arm 51 has a lateral stopper 52. The connecting arm 51 has a bottom part 53 fixed to a light module. The connecting arm 51 is inserted through a receiver slit 55 of a receiver of a driver box 56. After the lateral stopper 52 passes the receiver slit 55, the lateral stopper is recovered and form a fixing force to keep the connecting arm 51 at a predetermined position with respect to the driver box 56.

The bottom of the lateral stopper 52 may press the receiver 54 to ensure a close engagement between the connecting arm 51 and its connected light module to the driver box 56.

Figure 6:
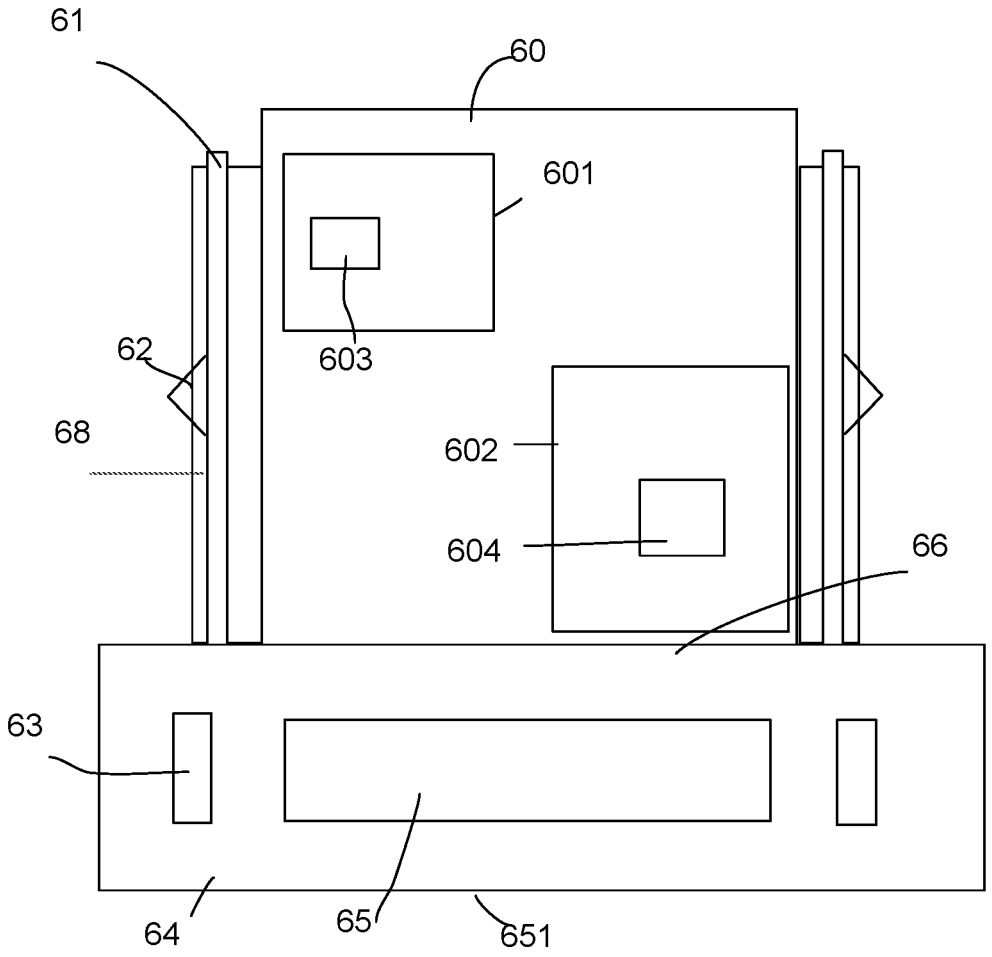
FIG. 6 illustrates another embodiment.

Please refer to FIG. 6. FIG. 6 illustrates another embodiment.

In FIG. 6, there are several candidate positions 601, 602 for locating a plastic driver box containing driver circuits 603, 604. The position 601 keeps driver circuits 603 with a distance from the back side 66 of the light module. The position 602 keeps the plastic driver box located at bottom of the driver box 60, leaving some space for containing wire connections to external wires of an external power source. Still, there may be a gap between the bottom of such plastic driver box and the bottom of the driver box 60.

There are two connecting arms 61 disposed at opposite sides of the driver box 60. The connecting arm 61 has a lateral stopper 62 to keep the connecting arm 61 at a relative position with respect to the driver box 60. In this example, the receiver slit 68 is a track for the connecting arm 61 to be inserted.

The light module 64 has a back cover 66 as part of its main housing. LED module 63 is disposed at lateral side of the light module. A light guiding plate 65 is used for guiding light to escape from a light opening 651.

Figure 7:
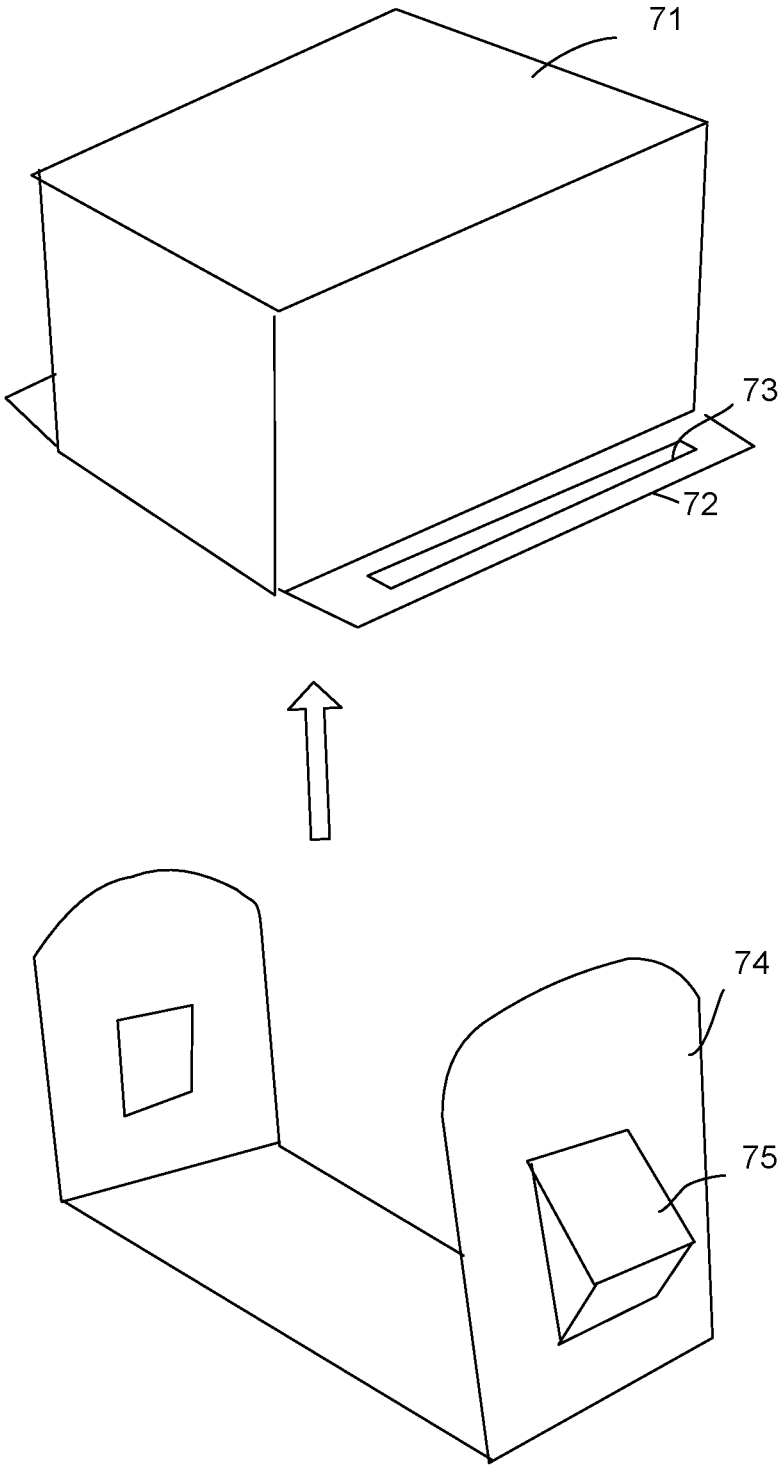
FIG. 7 illustrates a driver box fixing to connecting arms as one-piece metal unit.

Please refer to FIG. 7. FIG. 7 illustrates another example inserting a U shape connection device with two connecting arms 74 that have lateral stoppers 75 to a driver box 71 that has two receivers 72. Each receiver 72 has a receiver slit 73.

Figure 8:
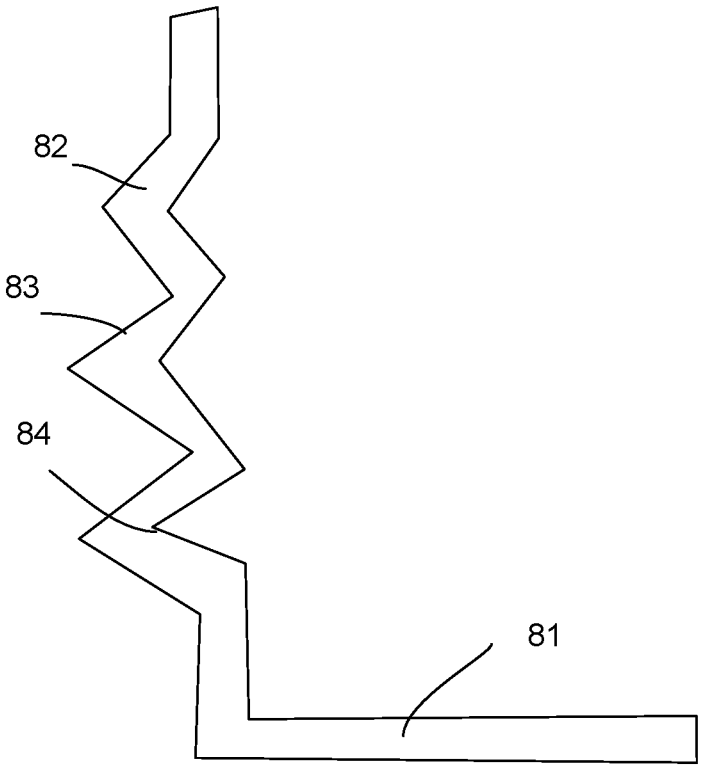
FIG. 8 illustrates a connecting arm with multiple segments.

Please refer to FIG. 8. FIG. 8 illustrates a connecting arm 81 that has multiple segments of lateral stoppers 82, 83, 84 so as to fit for various types of driver boxes.

In some embodiments, a driver circuit is disposed away from a bottom part of the driver box, the bottom part of the driver box engages the back cover of the light module. Specifically, the bottom part of the drive box is close to the light module and may receive more heat. By disposing the driver circuit away from the bottom part of the driver box may keep the driver circuit a better operating environment.

In some other embodiments, there is a plastic driver box containing a driver circuit. The plastic driver box is disposed at a bottom part of the driver box. The bottom part of the driver box is the part that engages the back cover of the light module.

There may be a gap between the bottom part of the driver box and a bottom side of the plastic driver box for preventing affecting the operation of the driver circuit by heat of the light module.

In addition, there may be a containing space for containing connection parts of wires of the plastic driver circuit and external wires connecting to an external power source. The wiring space may occupy 30%~50% size of the driver box for providing a safer configuration.

In addition to the above-described embodiments, various modifications may be made, and as long as it is within the spirit of the same invention, the various designs that can be made by those skilled in the art are belong to the scope of the present invention.

The invention claimed is:

1. A downlight apparatus, comprising:

a light module comprising a light source and a main housing, the light source being mounted with LED modules and placed in the main housing, the main housing having a light opening for light of the LED modules to escape out of the LED light apparatus, the main housing having a back cover;

a plurality of connecting arms fixed on the back cover of the light module, the connecting arm has a guiding top, a lateral stopper and a main body, the guiding top being located at a top side of the main body, the lateral stopper being located at a lateral side of the main body and protruding from the lateral side of the main body; and a driver box of metal material having a plurality of receivers for coupling to the corresponding connecting arms, the receiver having a receiver slit, after the guiding top and the lateral stopper of the connecting arm entering the receiver slit in sequence, a bottom side of the lateral stopper engaging the receiver and thus fixing the driver box to the light module and transmitting heat of the light source to the driver box.

2. The downlight apparatus of claim 1, wherein the lateral stopper is elastic to deform when passing the receiver slit and recovered after passing the receiver slit.

3. The downlight apparatus of claim 1, wherein the lateral stopper is a triangle protruding structure with a bottom part engaging a peripheral part of the receiver slit to keep the connecting arm a predetermined relative position with respect to the driver box.

4. The downlight apparatus of claim 1, wherein there are two connecting arms with two corresponding lateral stoppers, and each lateral stopper is a part of a single piece metal unit of the connecting arm.

5. The downlight apparatus of claim 4, wherein the lateral stoppers are formed by applying a metal stamping processing on the single piece metal unit.

6. The downlight apparatus of claim 4, wherein the two connecting arms are connected with a bottom part, the bottom parts are fixed to the back cover of the light module.

7. The downlight apparatus of claim 1, wherein there are more than three connecting arms.

8. The downlight apparatus of claim 1, wherein the receiver is a clip with a containing space for storing the lateral stopper after the lateral stopper passes the receiver slit for fixing the connecting arm to the driver box.

9. The downlight apparatus of claim 1, wherein the metal box is a cylinder shape, and the connecting arms have corresponding curve walls corresponding to the metal box.

10. The downlight apparatus of claim 1, wherein two of the connecting arms are connected with a shared bottom part, the shared bottom part having a protruding structure to keep a closer engagement with a surface of the driver box for better heat dissipation.

11. The downlight apparatus of claim 1, wherein the guiding top has a curve shape.

12. The downlight apparatus of claim 1, wherein there are two receiver slits disposed at two opposite sides of the driver box.

13. The downlight apparatus of claim 1, wherein the receiver slits are disposed on lateral sides of the driver box, the connecting arms entering tracks defined by the receiver slits.

14. The downlight apparatus of claim 1, wherein the lateral stopper has multiple segments corresponding to different types of the driver box.

15. The downlight apparatus of claim 1, wherein there is a flat area of the back cover for engaging the driver box.

16. The downlight apparatus of claim 1, wherein a driver circuit is disposed away from a bottom part of the driver box, the bottom part of the driver box engages the back cover of the light module.

17. The downlight apparatus of claim 1, wherein there is a plastic driver box containing a driver circuit, the plastic driver box is disposed at a bottom part of the driver box, the bottom part of the driver box engages the back cover of the light module.

18. The downlight apparatus of claim 17, wherein there is a containing space for containing connection parts of wires of the plastic driver circuit and external wires connecting to an external power source.

* * * * *